United States Patent [19]

Vermeersch et al.

[11] Patent Number: 4,820,613

[45] Date of Patent: Apr. 11, 1989

[54] PHOTOGRAPHIC SURFACE LAYERS COMPRISING DEXTRAN DERIVATIVES

[75] Inventors: Joan T. Vermeersch, Deinze; Hubert Vandenabeele, Mortsel; Jacques L. Vervecken, Berchem; Daniël M. Timmerman, Mortsel, all of Belgium

[73] Assignee: Agfa-Gevaert, N.V., Mortsel, Belgium

[21] Appl. No.: 79,081

[22] Filed: Jul. 29, 1987

[30] Foreign Application Priority Data

Sep. 23, 1986 [EP] European Pat. Off. ... EP86201641.7

[51] Int. Cl.[4] ..... G03C 1/30

[52] U.S. Cl. ..... 430/496; 430/621; 530/354

[58] Field of Search ..... 430/621, 622, 624, 496, 430/623; 530/354

[56] References Cited

U.S. PATENT DOCUMENTS 4,047,957 9/1977 De Winter ..... 430/621

FOREIGN PATENT DOCUMENTS 751134 11/1970 Belgium .

*Primary Examiner*—Won H. Louie

*Attorney, Agent, or Firm*—A. W. Breiner

[57] ABSTRACT

The present invention provides a method of hardening a proteinaceous surface layer of a photographic silver halide element by incorporating a dextran derivative in said proteinaceous surface layer, said dextran derivative being the reaction product of dextran and an epihalohydrin. The invention also provides a photographic element comprising at least one silver halide emulsion layer and at least one proteinaceous surface layer comprising the reaction product of dextran and an epihalohydrin.

12 Claims, No Drawings

PHOTOGRAPHIC SURFACE LAYERS COMPRISING DEXTRAN DERIVATIVES

DESCRIPTION

The present invention relates to a method of enhancing the resistance to abrasion in wet condition of photographic proteinaceous surface layers with the aid of dextran derivatives and to photographic elements comprising proteinaceous surface layers incorporating such dextran derivatives.

By resistance to abrasion in wet condition is to be understood herein the resistance to abrasion of photographic proteinaceous surface layers moistened by any of the commonly used aqueous liquids such as a developing bath, a fixing bath, a stabilizing bath, rinsing water, etc.. In this wet condition these photographic proteinaceous surface layers are in swollen state and thus particularly susceptible to scratching.

It is generally known to improve the mechanical properties of photographic layers such as silver halide emulsion layers, protective layers, antistatic layers, backing layers, filter layers, etc. by hardening the proteinaceous binders thereof, in particular gelatin. Various agents have been used for hardening proteinaceous binders and other polymers. Examples are chromium salts, aldehydes, s-triazines, epoxides, aziridines isocyanates etc. However, many of thee compounds have an adverse effect on the characteristics of the photographic element comprising them. Part of them bring about an increase in fog, or a reduction of the speed or gradation. Others have an insatisfactory hardening action. Still others enter into reaction at least in part with other ingredients such as dyes and colour couplers. Another important disadvantage of proteinaceous layers treated with classical hardeners is that the resistance to abrasion of such layers is still insufficient so that these layers receive scratch markings during manipulation. In DE-A No. 2,357,252 a method has been described for hardening photographic gelatin layers with reaction products of water-soluble polysaccharides and water-soluble 4,6-dichloro-s-triazines. However, in spite of enhancing the mechanical strength of photographic gelatin layers, many such agents significantly reduce the covering power of the developed silver.

Attempts have therefore been made to improve also the covering power of silver halide emulsion layers by adding various agents to the proteinaceous binder. For instance, according to U.S. Pat. No. 3,063,838, BE-P No. 585,486, and U.S. Pat. No. 3,203,804 dextran is added to silver halide gelatin emulsions to increase the covering power. However, the resistance to abrasion in wet condition of emulsion layers comprising dextran is too low so that these layers are vulnerable and can get scratched easily.

It is therefore an object of the present invention to provide a method of enhancing the resistance to abrasion in wet condition of proteinaceous surface layers of photographic silver halide elements whilst not impairing the covering power of the silver developed therein.

It is another object of the present invention to provide a photographic element comprising a silver halide emulsion layer and a proteinaceous surface layer incorporating improved hardeners, which do not have the above adverse effects.

These objects can be accomplished according to the present invention by a method of hardening a proteinaceous surface layer of a photographic silver halide element by incorporating a dextran derivative in said proteinaceous surface layer, characterized in that said dextran derivative is the reaction product of dextran and an epihalohydrin, preferably epichlorohydrin.

The present invention also provides a photographic element comprising at least one silver halide emulsion layer and at least one proteinaceous surface layer comprising the reaction product of dextran and an epihalohydrin, preferably epichlorohydrin.

It has been established surprisingly that in a photographic element comprising a silver halide emulsion layer and a proteinaceous surface layer incorporating the reaction product of dextran and an epihalohydrin a higher resistance to abrasion in wet condition is obtained before and after development than with common dextran alone, even though the absorption of water and the melting point of the proteinaceous surface layer remain almost unchanged. It has also been experienced that the covering power of the silver image formed in the developed photographic element comprising a proteinaceous surface layer incorporating the reaction product of dextran and an epihalohydrin was at least as high or even higher than that obtained in an analogous-photographic element comprising a proteinaceous surface layer incorporating common dextran. It was also found that the reaction products of dextran and an epihalohydrin have no adverse effect whatsoever on the photographic characteristics and that they have a reduced tencency to migrate from one layer to the other so that their influence on the mechanical characteristics of other layers is low.

The reaction products of dextran and an epihalohydrin can be incorporated in any type of surface layers e.g. protective or antistress layers, antistatic layers, backing layers, and filter layers. Of course, they can also be used for hardening other types of proteinaceous layers or compositions.

The reaction products of dextran and an epihalohydrin comprise dextran moieties, at least part of which have been modified by reaction with 1, 2, or 3 epihalohydrin molecules. The modified dextran moieties can be represented by the following general formula:

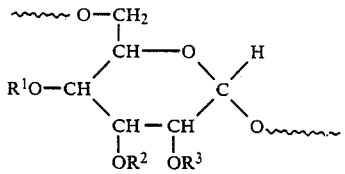

wherein: each of $R^1$, $R^2$, and $R^3$ represents hydrogen or $—CH_2—CHOH—CH_2X$, X being a halogen atom e.g. chlorine.

The reaction products of dextran and an epihalohydrin can be prepared as illustrated by the following Preparation.

PREPARATION

An amount of 200 g of dextran is dissolved in 1 l of demineralized water. An amount of 20 g of sodium hydroxide is added with stirring to the resulting solution. After complete dissolution of the sodium hydroxide 20 g of epichlorohydrin is added dropwise in about 30 min. The reaction mixture is stirred vigorously for 20 h and then neutralized with hydrochloric acid or phosphoric acid. The reaction mixture can be dialysed against water.

In the preparation of the dextran derivatives the ratio by weight of dextran to epihalohydrin may vary from about 100:5 to about 1:1, preferably from about 10:1 to about 10:4.

The dextran derivatives can be added in the form of an aqueous solution to a coating composition for forming a proteinaceous surface layer of a photographic element according to the present invention. Other solvents can be used alone or in combination with water for dissolving the dextran derivatives. Suitable solvents are water-miscible organic solvents such as methanol, ethanol, acetone, dioxan, acetonitrile, tetrahydrofuran, and dimethylformamide.

The solution of dextran derivatives can also be prepared in bulk and can be stored for a long time without loosing its effectiveness. A batch can be taken at any moment from the bulk and be added to an aqueous coating composition for forming a proteinaceous surface layer.

The proteinaceous surface layers of the photographic elements of the present invention comprise the reaction products of dextran and epihalohydrin in an amount ranging from about 1 to about 60% by weight, preferably from about 3 to about 35% by weight, of the dry proteinaceous material. The dextran derivatives for use according to the present invention can, of course, be added in combination with known hardeners.

The proteinaceous material that can be hardened successfully according to the method of the present invention can be any of the proteins customarily used as binder in photographic layers e.g. albumin, zein, collagen, keratin, casein. A preferred proteinaceous material is, however, gelatin.

The proteinaceous surface layers of the photographic elements of the present invention may comprise other ingredients such as matting agents e.g. silica, the polymer beads described in EP-A No. 0,080,225; wetting agents, antistatic agents, filter dyes, plasticizers, filling agents, and anti-Newton additives.

Suitable surface-active agents that can be added to the aqueous coating composition for forming a surface layer of the photographic elements of the present invention have been described in UK P Nos. 1,293,189 and 1,460,894, in BE P No. 742,680, and in U.S. Pat. No. 4,292,402. A survey of surface-active agents that can be added to the aqueous coating composition can be found in Gerhard Gawalek's "Wasch- und Netzmittel" Akademieverlag, Berlin (1962). Examples of suitable surface-active agents are the sodium salt of N-methyl-oleyltauride, sodium stearate, heptadecenylbenzimidazole sulphonic acid sodium salt, sodium sulphonates of higher aliphatic alcohols e.g. 2-methyl-hexanol sodium sulphonate, sodium diiso-octyl-sulphosuccinate, sodium dodecyl sulphate, tetradecyl benzene sulphonic acid sodium salt. Other interesting surface-active agents are the fluorinated surface-active agents like e.g. perfluorocaprylic acid ammonium salt.

Suitable antistatic agents that can be added to the aqueous coating composition for forming the surface layer have been described in EP-A O No. 180 668, which corresponds with the U.S. Ser. No. 790,183.

The thickness of the proteinaceous surface layer may range from about 0.5 to about 2.5 μm, preferably from 1 to 1.5 μm.

The silver halide used in the preparation of the photosensitive silver halide emulsion layer or layers of photographic elements according to the present invention can be silver bromide, silver iodide, silver chloride, or mixed silver halides e.g. silver chlorobromide, silver bromoiodide, and silver chlorobromoiodide.

The photosensitive silver halide emulsion layer or layers of photographic elements according to the present invention may contain the usual additives such as e.g. stabilizers, fog-inhibitors, speed-increasing compounds, colloid hardeners, plasticizers etc. The silver halide emulsions may be spectrally sensitized or non-spectrally sensitized.

The support of photographic elements according to the present invention can be a transparent film support as well as a non-transparent support.

When the support of the photographic element for use in accordance with the present invention is a non-transparent support, it usually is a paper support, preferably paper coated on one side or on both sides with an Alpha-olefin polymer, e.g. polyethylene.

Any conventional transparent hydrophobic resin film made of a cellulose ester e.g. cellulose triacetate, a polyester e.g. polyethylene terephthalate, polyvinylacetal, and polystyrene can be used as transparent film support. These hydrophobic resin film supports are preferably coated with at least one subbing layer to improve the adherence thereto of hydrophilic colloid layers e.g. of silver halide emulsion layers. Suitable subbing layers for that purpose have been described in e.g. U.S. Pat. No. 3,495,984; U.S. Pat. No. 3,495,985; U.S. Pat. No. 3,434,840; U.S. Pat. No. 3,788,856; and GB A No. 1,234,755.

The support of photographic elements according to the present invention can thus carry on one or on both sides thereof and in the given order: at least one subbing layer, at least one photosensitive silver halide emulsion layer, and at least one proteinaceous surface layer comprising the reaction product of dextran and epichlorohydrin.

The photographic elements according to the present invention can be of various types e.g. X-ray photographic elements including both medical type and industrial type for non-destructive testing, photographic elements for graphic arts and for so-called amateur and professional photography, continuous tone or high contrast photographic elements, photographic motion picture elements, photographic elements including image-receiving elements for silver complex or colour diffusion transfer processes, photographic elements comprising non-spectrally sensitized emulsions or spectrally sensitized emulsions, high-speed or low-speed photographic elements, and black-and-white or colour photographic elements.

The following examples illustrate the present invention.

EXAMPLE 1

The pH-value of a 5% aqueous gelatin solution comprising 16 ml of a 4% aqueous solution of formaldehyde and 10 ml of a 5% aqueous solution of perfluorocaprylic acid ammonium salt was adjusted to 7.0 with sodium hydrogen carbonate and divided in 3 equal parts.

Sample A: a 20% aqueous solution of commercially available dextran was added to the first part in such an amount that the ratio by weight of dry gelatin to dry dextran was 3:1.

Sample B: a 20% aqueous solution of the reaction product of dextran and epichlorohydrin, prepared as described in the Preparation hereinbefore and stored in bulk for 5 days, was added to the second part in such an amount that the ratio by weight of dry gelatin to the dry reaction product of dextran and epichlorohydrin was 3:1.

Sample C: a 20% aqueous solution of the reaction product of dextran and epichlorohydrin, freshly prepared as described in the Preparation hereinbefore, was added to the third part in such an amount of that the ratio by weight of dry gelatin to the dry reaction product of dextran and epichlorohydrin was 3:1.

Each sample was then coated at a ratio of 0.6 g per m2 on a polyethylene terephthalate support and dried. After a storage of 2 h at 57° C. in a relative humidity of 34% the absorption of water, the melting point, and the resistance to abrasion of each sample were determined. The absorption of water was measured gravimetrically. The resistance to abrasion of each sample, having been immersed in water at 20° C., was measured by means of a device, in which a steel ball is drawn over the swollen sample, the ball having a diameter of 3 mm. The ball can be charged with a continuously increasing weight, the resistance to abrasion corresponding to the lowest weight (expressed in gram), at which the ball starts scratching the sample visibly when viewed in transmission. The results are listed in Table 1.

TABLE 1

| | Absorption of water in g/m2 | Melting point in °C. | Resistance to abrasion in wet condition |
|---|---|---|---|
| Sample A | 11.6 | 80 | 120 |
| Sample B | 12.2 | 80 | 180 |
| Sample C | 11.8 | 80 | 170 |

These results show that the Samples B and C comprising the reaction product of dextran and epichlorohydrin according to the present invention have a considerably higher resistance to abrasion in wet condition than Sample A comprising common dextran alone, in spite of the fact that the changes in absorption of water and melting point between the 3 samples are negligible.

EXAMPLE 2

A layer was coated on a polyethylene terephthalate support from a coating composition, which was exactly identical to that of Sample B described in Example 1. The resulting Sample F, dried and stored as described in Example 1, was then compared with two Samples D and E having an identical composition except for the reaction product of dextran and epichlorohydrin, which in the case of Sample D was replaced by the hardener epichlorohydrin in an amount of 0.4 ml per m2 and in the case of Sample E by an equimolar amount of commercially available dextran.

The absorption of water, the melting point, and the resistance to abrasion of each sample were determined. The results are listed in Table 2.

TABLE 2

| | Absorption of water in g/m2 | Melting point in °C. | Resistance to abrasion in wet condition |
|---|---|---|---|
| Sample D | 11.7 | 80 | 100 |
| Sample E | 11.7 | 80 | 120 |
| Sample F | 11.9 | 80 | 180 |

These results show that, in spite of the fact that the absorption of water and the melting point of the 3 layers are practically identical, the resistance to abrasion in wet condition of Sample F according to the present invention is considerably higher than that of Sample E comprising commercially available dextran and by far higher than that of Sample D comprising epichlorohydrin.

EXAMPLE 3

A gelatin silver bromoiodide (2 mol% of iodide) medical X-ray emulsion comprising per kg of emulsion 65 g of gelatin was coated on both sides of a subbed polyethylene terephtalate support at a ratio of about 23 m2 per kg of emulsion per side. Each of the resulting emulsion layers had a silver content (expressed in silver nitrate) of 5 g per m2.

Two identical strips G and H were cut from the resulting material and, while still wet, covered on both sides with the following aqueous coating composition, which in the case of strip G (comparison material) comprised commercially available dextran as dextran compound and in the case of strip H the reaction product of dextran and epichlorohydrin prepared as described in the Preparation hereinbefore (material according to the present invention). The aqueous coating composition comprised:

| | |
|---|---|
| gelatin | 40 g |
| dextran compound | 5 g |
| 5% aqueous solution of the ammonium salt of perfluorocaprylic acid | 10 ml |
| 5% aqueous solution of sodium diisooctyl sulphosuccinate | 18 ml |
| 4% aqueous solution of formaldehyde | 16 ml |
| water to make | 1000 ml |

Each of the gelatin surface layers was coated at a ratio of 1.1 g of gelatin per m2 and had a thickness of 1.0 μm. After having been dried and stored for 48 h at 57° C. and a relative humidity of 34%, the gelatin surface layers on strips G and H were found to have a melting point higher than 80° C.

Both resulting Elements G and H were exposed and developed in a developer at 35° C. comprising:

| | |
|---|---|
| methylaminophenol | 2.0 g |
| anhydrous sodium sulphite | 90.0 g |
| hydroquinone | 8.0 g |
| sodium carbonate monohydrate | 52.5 g |
| anhydrous potassium bromide | 5.0 g |
| water to make | 1000 ml |

The covering power of the silver image developed in Elements G and H was then measured. The covering power is the reciprocal of the photographic equivalent of developed silver, i.e. the number of grams of silver per sq. decimeter divided by the maximum optical density. The resistance to abrasion of the wet surface layers was determined as described in Example 1. The values measured are listed in Table 3

TABLE 3

| | Resistance to abrasion in wet condition | Covering power |
|---|---|---|
| Element G (commercial dextran) | 120 | 37 |
| Element H (reaction product acc. to present invention). | 180 | 38 |

These results show that the resistance to abrasion of Element H carrying surface layers according to the present invention was higher than that of Element G and that the covering power of the silver image formed in the developed Element H was even higher than that obtained in Element G comprising the commercially available dextran. It was also found that neither the reaction product of dextran and an epihalohydrin nor the commercial dextran had any adverse influence on the photographic characteristics. Moreover, the tencency of the reaction product of dextran and an epihalohydrin of migrating from the surface layer to the emulsion layer was low.

We claim:

1. Method of hardening a proteinaceous layer of a photographic silver halide element by incorporating in said proteinaceous layer a reaction product of dextran and an epihalohydrin capable of functioning as a hardener.

2. A method according to claim 1, wherein said epihalohydrin is epichlorohydrin.

3. A method according to claim 1, wherein in said reaction product the ratio by weight of dextran to epihalohydrin varies from about 10:1 to about 10:4.

4. A method according to claim 1, wherein said reaction product of dextran and epihalohydrin is present in an amount ranging from about 3 to about 35% by weight, of the dry proteinaceous material.

5. A method according to claim 1, wherein said proteinaceous material is gelatin.

6. A method according to claim 1, wherein the thickness of said proteinaceous layer ranges from 1 to 1.5 μm.

7. Photographic element comprising at least one silver halide emulsion layer and at least one proteinaceous layer comprising a reaction product of dextran and an epihalohydrin capable of functioning as a hardener.

8. A photographic element according to claim 7, wherein said epihalohydrin is epichlorohydrin.

9. A photographic element according to claim 7, wherein in said reaction product the ratio by weight of dextran to epihalohydrin varies from about 10:1 to about 10:4.

10. A photographic element according to claim 7, wherein said reaction product of dextran and epihalohydrin is present in an amount ranging from about 3 to about 35% by weight, of the dry proteinaceous material.

11. A photographic element according to claim 7, wherein said proteinaceous material is gelatin.

12. A photographic element according to claim 7, wherein the thickness of said proteinaceous layer ranges from 1 to 1.5 μm.

* * * * *